US006622621B2

(12) United States Patent
Bucher et al.

(10) Patent No.: US 6,622,621 B2
(45) Date of Patent: Sep. 23, 2003

(54) DEVICE FOR DETECTING REGISTER MARKS

(75) Inventors: Harald Bucher, Eschelbronn (DE); Frank Schumann, Heidelberg (DE)

(73) Assignee: Heidelberger Druckmaschinen AG, Heidleberg (DE)

( * ) Notice: Subject to any disclaimer, the term of this patent is extended or adjusted under 35 U.S.C. 154(b) by 90 days.

(21) Appl. No.: 09/954,908

(22) Filed: Sep. 18, 2001

(65) Prior Publication Data

US 2002/0096069 A1 Jul. 25, 2002

(30) Foreign Application Priority Data

Sep. 18, 2000 (DE) ..... 100 46 031

(51) Int. Cl.[7] ..... B41F 13/54

(52) U.S. Cl. ..... 101/228; 101/485; 101/211; 101/181; 250/559.48; 250/559.3

(58) Field of Search ..... 101/232, 248, 101/483, 484, 485, 228, 216, 181, 183, 219, 211; 250/559.29, 559.3, 559.37, 559.44, 559.48, 559.01

(56) References Cited

U.S. PATENT DOCUMENTS 2,802,666 A * 8/1957 Crosfield ..... 101/181
3,701,464 A * 10/1972 Crum ..... 101/181
4,401,024 A * 8/1983 Frentress ..... 101/248
4,450,766 A * 5/1984 Inomata et al. ..... 101/183
4,731,542 A * 3/1988 Doggett ..... 250/559.3
5,313,886 A * 5/1994 Miller ..... 250/559.3
5,992,318 A * 11/1999 DiBello et al. ..... 101/181
6,022,154 A * 2/2000 Allen ..... 101/181
6,199,480 B1 * 3/2001 Leonhardt et al. ..... 101/248

FOREIGN PATENT DOCUMENTS

DE 42 18 764 A1 12/1993

OTHER PUBLICATIONS

Anonymous: "Kombinierte Überprüfung der Passergenauigkeit" [combined checking of register mark accuracy], *Druck Print*, vol. 4, 1981, pp. 254, 260.

* cited by examiner

*Primary Examiner*—Eugene H. Eickholt
(74) *Attorney, Agent, or Firm*—Laurence A. Greenberg; Werner H. Stemer; Gregory L. Mayback

(57) ABSTRACT

A device for detecting register marks includes at least one receiver for scanning register marks along a track disposed in a direction of movement of the register marks, and a device for positioning the receiver transversely with respect to the track, in order to determine an offset of the receiver with respect to the track, at least one positioning mark being disposed upline of the register marks in the direction of movement thereof, the positioning mark having at least one edge extending at an angle to the track, having an extent transverse to the track, which is a multiple of the extent of the register marks, and having a predetermined positional relationship to the track which is transverse to the track.

5 Claims, 2 Drawing Sheets

DEVICE FOR DETECTING REGISTER MARKS

BACKGROUND OF THE INVENTION

Field of the Invention

The invention relates to a device for detecting register marks.

In multicolor printing, in order to ensure exact overprinting of separated colors or separations, it has become known heretofore to print register marks in each separation. In order not to restrict unnecessarily the space on a printing material available for a print, and to keep the expenditure for register mark scanning devices low, the register marks are provided with relatively small dimensions along a track in the conveying direction of the printing material. The register mark scanning devices can be positioned transversely with respect to the conveying direction in order to be alignable with the narrow track. In the case of automated positioning devices, the register mark scanning device carries out a search run until the track has been found and the register mark scanning device is aligned with the center of the track. In order to find the track better, it has become known heretofore to use advance marks, which are arranged upline of the register marks and which, in the conveying direction, have a length which is a multiple of the length of individual register marks (note the published German Patent Document DE 42 18 764 A1). In spite of these advance marks, the duration of the search and the positioning is relatively lengthy, so that a relatively large number of deficient prints have to be produced until register control can be carried out using the register marks.

SUMMARY OF THE INVENTION

It is an object of the invention to provide a device for detecting register marks which permits rapid positioning of a register mark detector, so that the number of deficiently produced prints are reduced.

With the foregoing and other objects in view, there is provided, in accordance with the invention, a device for detecting register marks, comprising at least one receiver for scanning register marks along a track disposed in a direction of movement of the register marks, and a device for positioning the receiver transversely with respect to the track, in order to determine an offset of the receiver with respect to the track, at least one positioning mark being disposed upline of the register marks in the direction of movement thereof, the positioning mark having at least one edge extending at an angle to the track, having an extent transverse to the track, which is a multiple of the extent of the register marks, and having a predetermined positional relationship to the track which is transverse to the track.

In accordance with another feature of the invention, the positioning mark is formed as a right-angled triangle having one adjacent side thereof disposed in the direction of movement of the register marks.

In accordance with a further feature of the invention, the adjacent side disposed in the direction of movement of the register marks is aligned with a center line of the track.

In accordance with an added feature of the invention, the track is located at an edge of a printing material, and the other adjacent side of the triangular positioning mark extends at least approximately to the edge of the printing material, starting from the center line of the track.

In accordance with a concomitant feature of the invention, in the direction of movement of the register marks, at least two reference lines are producible in the vicinity of the positioning mark.

Due to the provision of a specific positioning mark, which is produced in a defined position in relation to the register marks, a position-dependent signal can be derived, from which the distance of the receiver from the register mark track can be calculated. This distance is available after only one scan of a positioning mark, and the positioning of the receiver can be carried out without delay. The only precondition is that the receiver should also register the positioning mark at the start of the positioning operation, which is readily provided by the large lateral extent of the positioning mark. The starting position of the receiver can be predefined by an entry from an operator. In another embodiment of the invention, the starting position in the case of a known printing-material format can be defined as a distance from a lateral printing-material edge.

It is also noted that the invention is applicable either to printing on sheets or webs.

Other features which are considered as characteristic for the invention are set forth in the appended claims.

Although the invention is illustrated and described herein as embodied in a device for detecting register marks, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
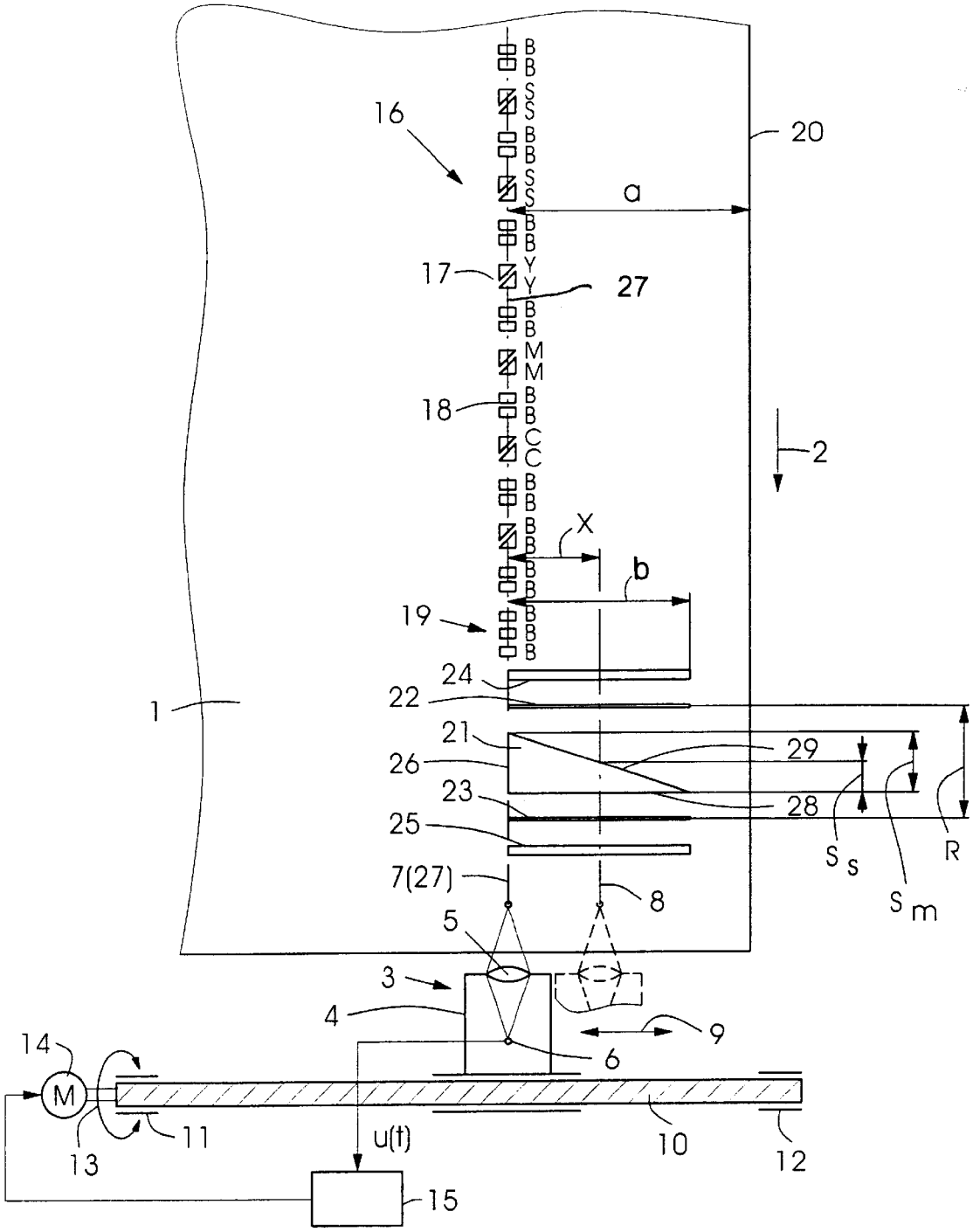
FIG. 1 is a diagrammatic view of a device for detecting register marks according to the invention.

Referring now to the drawings and, first, particularly to FIG. 1 thereof, there is shown therein a sheet 1, which is conveyed past a register mark detector 3 in a direction represented by the arrow 2. The register mark detector 3 includes a housing 4, an optical imaging system 5 and a photoelectric converter 6. With the aid of the imaging system 5, light passes along a scanning line 7, 8 from the surface of the sheet 1 to the converter 6. The register mark detector 3 can be positioned in the direction 9, transversely with respect to the travel direction 2 of the sheet 1. For the purpose of positioning the register mark detector 3, the housing 4 is coupled to a linear screw or worm drive 10. The screw drive 10 is mounted in bearings 11 and 12 on either side of the travel path of the sheet 1. When the screw drive 10 is rotated in the direction 13 by a stepping motor 14, the housing 4 is displaced in the direction 9. In order to evaluate the output signals, the converter 6 is connected to a control arrangement 15.

To measure the register deviations, triangular register marks 17, section reference marks 18 and advance marks 19 are printed in a straight track 16. The track 16 runs at a distance a parallel to the side edge 20 of the sheet 1 and parallel to the direction 2. The advance marks 19 include three rectangular marks of the color black b. The section reference marks 18 are likewise produced in the color black b and are located adjacent to the register marks 17 or to a group of register marks 17. The register marks 17 are produced in the primary colors black b, cyan C, magenta M, yellow Y and in special colors S. Upline of the track 16, as viewed in the sheet-conveying or travel direction 2 there is a triangular positioning mark 21, upline and downline from which there is, respectively, a thin and a thick reference line 22, 23, 24, 25. The positioning mark 21 has the form of a right-angled triangle with unequal sides. The shorter adjacent side 26 has the length Sm and is aligned with the center line 27 which, in the drawing, coincides with the scanning line 7. The longer adjacent side 28 has a length b and extends at right angles to a center line 27 of the track 16, in the direction of the side edge 20 of the sheet 1. The hypotenuse 29 of the positioning mark 21 is located at an angle to the center line 27 of the track 16. The thin reference lines 22, 23 are located at a distance R from one another in the conveying or travel direction 2.

Figure 2:
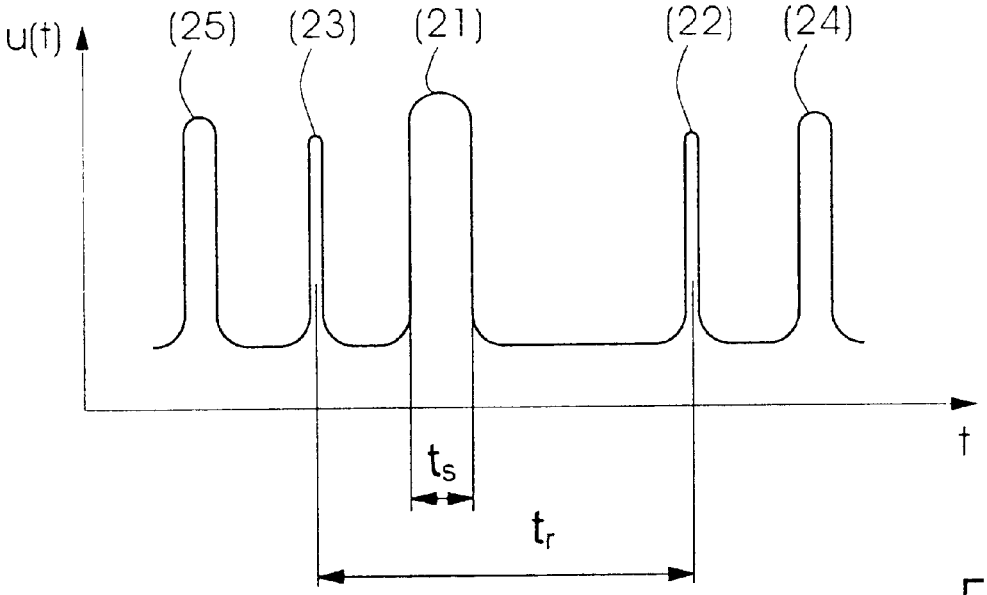
FIG. 2 is a diagram of an output signal from a register mark receiver.

The mode of operation of the device according to the invention is described hereinbelow. It is an objective of the invention to align the register mark detector 3 in the lateral direction 9 as quickly as possible to the center line 27 of the track 16, which is about 2 mm wide. In the initial state, the register mark detector 3 is offset laterally a distance X with respect to the center line 27. In the initial state, the register mark detector 3 is located between the center line 27 and the sheet side edge 20 so that, in every case, the detector 3 registers the reference lines 22 to 25 and the positioning mark 21 along the scanning line 8. During the passage of a first sheet 1, the signal u(t) shown in FIG. 2 is produced at the converter 6 during the scanning of the reference line 25, 23, of the positioning mark 21 and of the reference lines 22, 24. Because the reference lines 23 and 22 are located relatively close to the positioning mark 21, it is assumed that the speed of the sheet 1 between the reference lines 23 and 22 is uniform. There is therefore the following relationship between the duration tr of the occurrence of the signal pulses from the reference lines 23 and 22 and the duration ts, which represents the pulse width between the scanning of the adjacent side 28 and the hypotenuse 29:

$$\frac{t_s}{t_r} = \frac{S_s}{R} \tag{1}$$

Ss identifies the distance between the hypotenuse 29 and the adjacent side 28 in the direction of the scanning line 8. In addition, in accordance with the radiation law:

$$\frac{b}{S_m} = \frac{x}{S_m - S_s} \tag{2}$$

Equations (1) and (2) result in x, the amount by which the register mark detector 3 has to be displaced in order to be able to carry out the scanning along the center line 27 in the case of all the following sheets 1:

$$x = \left(1 - \frac{t_s \times R}{t_r \times S_m}\right) \times b$$

The calculation of the variable x can be carried out in the control device 15. The variables R, Sm and b are predefined, ts and tr are given by simple signal evaluations with the aid of a timer. In the control device 15, an actuating signal for the motor 14 is generated by using the offset x. The motor 14 rotates the screw drive 10 in the direction 13 until the register mark detector 3 has been displaced from the scanning line 8 to the scanning line 7.

In order to determine the rotation of one of the separations, the arrangement can be provided on both sides at the edges of a respective sheet 1. Of course, the arrangement can also be used when printing on webs.

We claim:

1. A device for detecting register marks, comprising at least one receiver for scanning register marks along a track disposed in a direction of movement of the register marks, and a device for positioning the receiver transversely with respect to said track, in order to determine an offset of said receiver with respect to said track, at least one positioning mark being disposed upline of the register marks in said direction of movement thereof, said positioning mark having at least one edge extending at an angle to said track, having an extent transverse to said track, which is a multiple of the extent of the register marks, and having a predetermined positional relationship to said track which is transverse to said track.

2. The detecting device according to claim 1, wherein said positioning mark is formed as a right-angled triangle having one adjacent side thereof disposed in said direction of movement of the register marks.

3. The detecting device according to claim 2, wherein said adjacent side disposed in said direction of movement of the register marks is aligned with a center line of said track.

4. The detecting device according to claim 3, wherein said track is located at an edge of a printing material, and the other adjacent side of said triangular positioning mark extends at least approximately to said edge of the printing material, starting from said center line of said track.

5. The detecting device according to claim 1, wherein, in said direction of movement of the register marks, at least two reference lines are producible in the vicinity of said positioning mark.

* * * * *